United States Patent [19]

Haldi

[11] 4,018,368

[45] Apr. 19, 1977

[54] DEVICE FOR FOLDING SHEETS AND THE LIKE

[75] Inventor: Bernhard A. Haldi, New York, N.Y.

[73] Assignee: The Raymond Lee Organization, Inc., a part interest

[22] Filed: Oct. 21, 1975

[21] Appl. No.: 624,318

[52] U.S. Cl. ..... 223/37; 24/137 A; 24/81 B; 24/81 GS; 270/61 R

[51] Int. Cl.² ..... A41H 33/00

[58] Field of Search ..... 24/81 B, 81 GS, 137 A, 24/263 SB; 223/1, 2, 37, 38, 61; 270/61 R, 78, 80; 269/189, 254 R

[56] References Cited

UNITED STATES PATENTS

| | | | |
|---|---|---|---|
| 2,491,972 | 12/1949 | Halote | 269/254 X |
| 2,998,247 | 8/1961 | McCloskey | 24/81 GS |
| 3,510,031 | 5/1970 | Robinson | 223/37 |
| 3,538,555 | 11/1970 | Langston | 29/137 A |
| 3,713,643 | 1/1973 | Gerstenberger | 270/61 R |

*Primary Examiner*—G. V. Larkin

[57] ABSTRACT

A wall mounted clamp has two vertical jaws extending perpendicularly away from the wall. One jaw is fixed, and the other jaw is movable. The jaws are spring loaded against each other. The jaws can be opened by depressing a floor mounted pedal; releasing the pedal causes the jaws to come together again. A horizontal rod rotatable about its axis is vertically slidable in a vertical slot adjacent the pedal. The rod extends at right angles to the wall. A weight normally holds the rod in lowest position ready for use.

3 Claims, 5 Drawing Figures

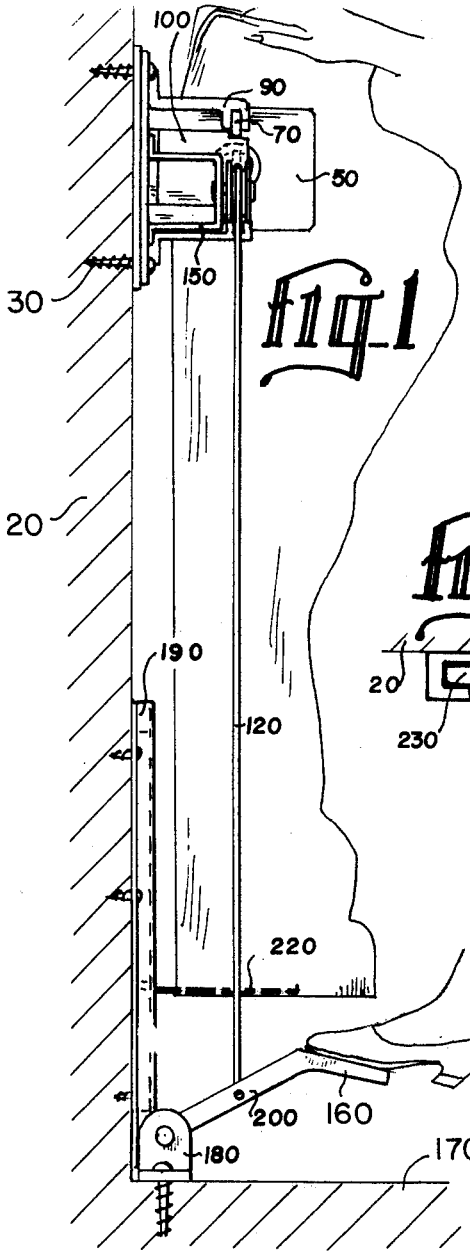
fig_1
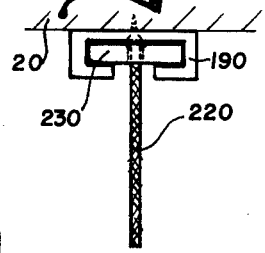
fig_4
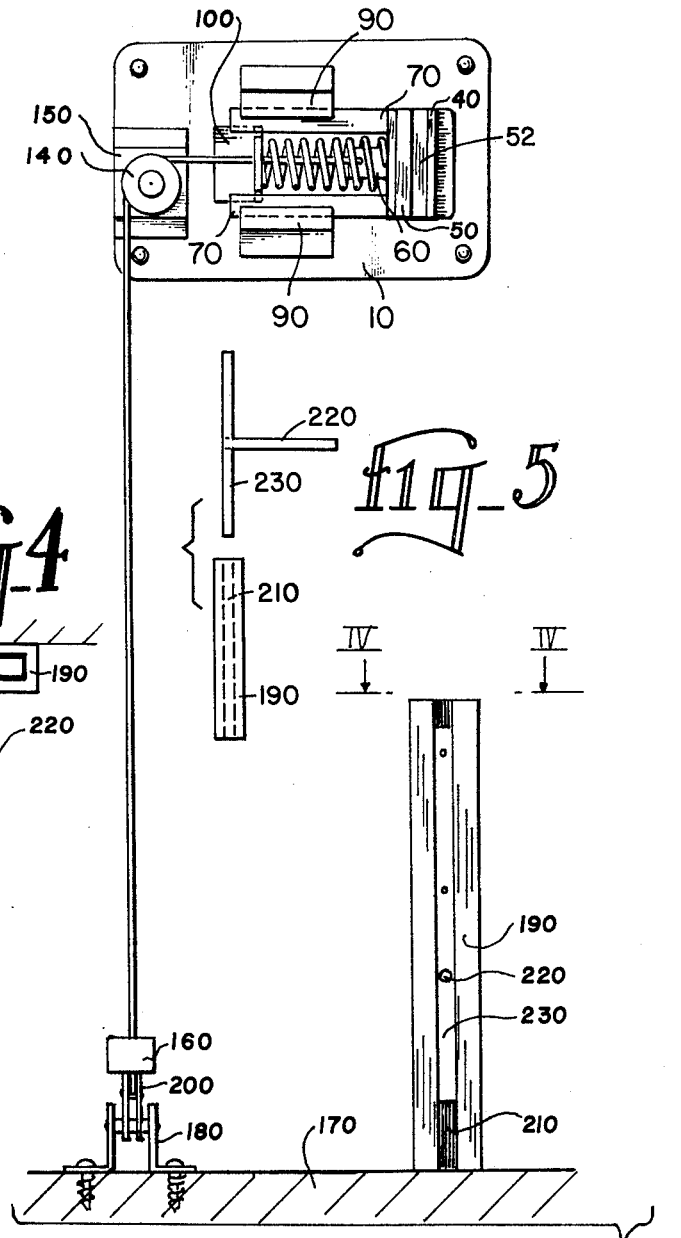
fig_5
fig_2
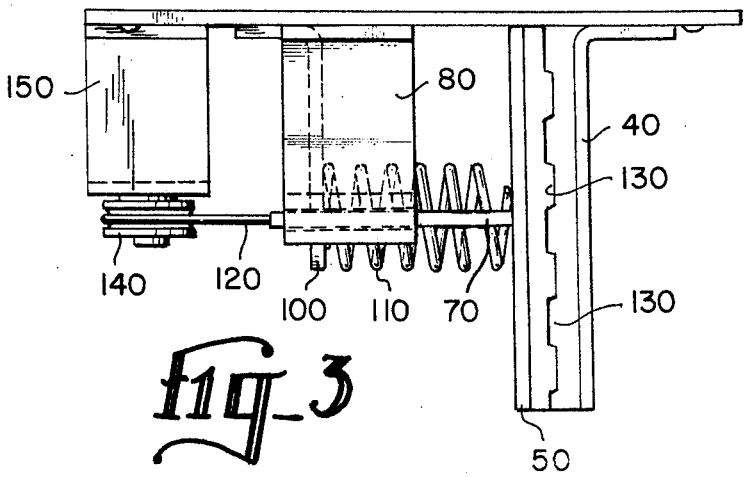
fig_3

DEVICE FOR FOLDING SHEETS AND THE LIKE

SUMMARY OF THE INVENTION

This invention is designed to ease the task of a housewife who must fold sheets and the like by facilitating the folding action.

In this invention, a clamp with vertical jaws is attached to a wall. The clamp is operable by a floor mounted pedal.

A horizontal rod extends perpendicularly outward from the wall adjacent the pedal. The rod is secured to a weight and is vertically slidable in a slot. The weight normally holds the rod in lowest position. The rod is rotatable about its axis. When the housewife wishes to fold an item, she holds the sheet so that it is wrapped around the rod and extends upward, pulls the upper horizontal edges of the sheet into alignment and then places these edges into the clamp and depresses the pedal to hold the sheet. Since the weight always exerts a downward pull on the rod, the rod pulls downward against the sheet wrapped therearound and holds the sheet taut to facilitate folding. The sheet is then released from the rod and can be refolded as required by repeating the process.

BRIEF DESCRIPTION OF THE DRAWINGS

FIG. 1 is a side view of the invention.

FIG. 2 is a front view of the invention.

FIG. 3 is a top view of the invention.

FIG. 4 is a detail view of a portion of the invention.

FIG. 5 is an exploded detail side view of the rod and weight.

DETAILED DESCRIPTION OF PREFERRED EMBODIMENTS

Referring now to FIGS. 1–4, a flat rectangular plate 10 is attached to a wall 20 by four screws 30. A metal support member 40 is bent into an L-shape. The shorter portion of the piece is welded to the plate, the longer portion of the piece forms a vertical fixed jaw 52 extending away from the plate at right angles.

A flat rectangular piece of metal forms a movable jaw 50 to oppose the fixed jaw. A horizontally elongated tab 60 is attached to the said 50 and extends off to the left as viewed from the front. Elongated strips 70 also extend away from said 50 to the left as viewed from the front, but above and below the tab.

The strips 70 serve as rails along which the jaw 50 can be moved back and forth with respect to the fixed jaw. Two opposed flanges 80 have vertical sections 90 that are parallel to the wall and are hooked over the strips, each flange being directly forward of a corresponding strip. To press the strips against sections 90, and thus to allow the movable jaw to be moved only in a horizontal direction, flange 100 is attached to the plate and extends perpendicularly away from the wall. The flange is notched at its front corners, so that the rear edges of the notches will press against the rear sides of the strips. The flange then narrows, to allow it to pass between the strips. Finally, a compression spring 110 is interposed between the movable jaw and the right-hand face of flange 100, keeping the jaws urged together. It may thus be seen that the jaws will be pressed together, unless the tab on the movable jaw is pulled to the left as viewed from the front by flexible nylon cord 120.

In order to better grip sheets and the like between the jaws, mating teeth 130 are molded into two plastic members that are each attached to the inner surface of a corresponding jaw.

A pulley 140 that spins in a vertical plane is attached at the forward end of post 150 that is attached at its rear end to the plate. The cord is looped over the pulley, thus having a horizontal direction between the pulley and the movable jaw and vertical direction otherwise.

The cord extends downwardly from the pulley to the midpoint of linkage 200. Linkage 200 terminates at one end in foot pedal 160 and is pivotally secured at the other end to the floor 170 by vertical flanges 180.

The cord is attached to the linkage to form a second-class lever. When the pedal is depressed, the cord is pulled downwardly and the movable jaw pulled to the left against the pressure of the spring. Releasing the pedal allows the spring to restore the original position of the jaws, with each one pressing on the other.

A vertical member 190 having a vertical slot 210 is secured to the wall adjacent the pedal. A horizontal rubber rod disposed at right angles to the wall and rotatable about its axis as shown at 220 is slidable in the slot and is secured to a 10 pound weight 230. The weight 230 and rod 220 form a unit which is vertically slidable in member 190, since member 190 forms a channel. This weight normally holds the rod in lowest position by gravity. If the pull of the sheet against the rod is sufficiently strong to overcome the downward force of weight 230, the weight and rod will be moved vertically upward in member 190.

When the housewife positions the sheet around the rod, the rotatability of the rod facilitates positioning of the sheet. The rod can be pulled up in the slot against the pull of the weight as required by the dimensions of the sheet. Of course other items besides sheets such as pillow cases, blankets and the like can be folded in the same manner. The invention can be used industrially or commercially as well as in the home.

Although the invention has been described with particular reference to the drawings, the protection sought is to be limited only by the terms of the claims which follow.

What is claimed is:

1. A device adapted to be secured both to a wall and a floor to facilitate folding of sheets and the like, said device comprising:

a flat plate disposed vertically and secured to said wall;

a fixed jaw extending perpendicularly outward from the wall in a vertical plane;

a movable jaw parallel to the fixed jaw and horizontally slidable along the plate toward and away from the fixed jaw, said movable jaw being slidably secured to the plate;

means secured to said plate to confine the motion of the movable jaw to the horizontal plane;

a spring biasing said movable jaw against the fixed jaw; and a foot operated mechanism on the floor and connected to the movable jaw, said mechanism including a foot operated pedal disposed on one end of an elongated linkage, said linkage being pivotally secured at its opposite end to the floor, a pulley lying in a vertical plane and rotatable therein, said pulley being disposed adjacent said plate and movable jaw, and a flexible cord secured at one end to a point on the linkage intermediate its ends, said cord extending vertically upwards from the linkage, engaging said pulley to the movable jaw, the other end of the cord being secured to the movable jaw, said cord being attached to the linkage to form a lever of the second class, said pedal when depressed causing said cord to pull said movable jaw away from the fixed jaw against the bias of the spring.

2. The device of claim 1 wherein said jaws have teeth which are disposed in mating engagement when the movable jaw is in contact with the fixed jaw.

3. The device of claim 2 further including a support secured to the wall, a weight vertically slidable in said support, and a horizontal rod secured at one end to the weight and extending outward at right angles to the wall whereby when a sheet is wrapped around the rod and has upper horizontal aligned edges engaged by the jaws, the weight pulls downward upon the rod and holds the sheet taut.

* * * * *